United States Patent [19]

Mills

[11] 4,140,343

[45] Feb. 20, 1979

[54] GAS WITHDRAWAL FROM AN IN SITU OIL SHALE RETORT

[75] Inventor: Eugene A. Mills, Whittier, Calif.

[73] Assignee: Occidental Oil Shale, Inc., Grand Junction, Colo.

[21] Appl. No.: 768,580

[22] Filed: Feb. 14, 1977

[51] Int. Cl.[2] ..... E21C 41/10; E21F 1/00

[52] U.S. Cl. ..... 299/2; 299/12; 299/19

[58] Field of Search ..... 299/2, 4, 5, 11, 12, 299/19

[56] References Cited

U.S. PATENT DOCUMENTS

| | | | |
|---|---|---|---|
| 2,630,306 | 3/1953 | Evans | 208/11 |
| 2,801,089 | 7/1957 | Scott, Jr. | 299/2 |
| 3,001,776 | 9/1961 | Poollen | 299/2 |
| 3,661,423 | 5/1972 | Garret | 299/2 |
| 4,017,119 | 4/1977 | Lewis | 299/2 |

OTHER PUBLICATIONS

Report to Lawrence Livermore Laboratory, by Golder Associates, 10-1974.

Research & Development on Rubble In-Situ Extraction of Oil Shale at Lawrence Livermore Lab, Rothman, Quarterly Col. School of Mines, Apr. 1975, pp. 159-178.

"Technical and Economic Study of an Underground Mining, Rubblization and In -Situ Retorting System. . . .", Aug. 1975, NTIS PB249344, pp. 91-103.

*Primary Examiner*—Ernest R. Purser

*Assistant Examiner*—William F. Pate, III

*Attorney, Agent, or Firm*—Christie, Parker & Hale

[57] ABSTRACT

Liquid and gaseous products are recovered from oil shale in an in situ oil shale retort containing a fragmented permeable mass of particles containing oil shale by retorting oil shale in the fragmented mass to produce gaseous and liquid products. The liquid products are withdrawn from the retort to a first level in unfragmented formation below the elevation of the bottom boundary of the retort. Gaseous products are withdrawn from the retort to a second level below the elevation of the first level.

45 Claims, 5 Drawing Figures

GAS WITHDRAWAL FROM AN IN SITU OIL SHALE RETORT

BACKGROUND OF THE INVENTION

The presence of large deposits of oil shale in the Rocky Mountain region of the United States has given rise to extensive efforts to develop methods of recovering shale oil from kerogen in the oil shale deposits. A number of methods have been developed for processing the oil shale which involve either first mining the kerogen bearing shale and processing the shale on the surface, or processing the shale in situ. The latter approach is preferable from the standpoint of environmental impact since the spent shale remains in place, reducing the chance of surface contamination and the requirement for disposal of solid wastes.

The recovery of liquid and gaseous products from a subterranean formation containing oil shale has been described in several issued patents, one of which is U.S. Pat. No. 3,661,423, issued May 9, 1972, to Donald E. Garrett, assigned to the assignee of this application, and incorporated herein by reference. This patent describes the in situ recovery of liquid and gaseous carbonaceous products from subterranean formations containing oil shale by preparing an in situ oil shale retort in the subterranean formation. The retort is formed by excavating a production tunnel or drift in the subterranean formation, mining at least one void in the formation within the boundaries of the in situ oil shale retort being formed, and explosively expanding formation toward such a void to form a fragmented permeable mass of formation particles containing oil shale, referred to herein as an in situ oil shale retort. Hot retorting gases are passed through the in situ oil shale retort to convert kerogen contained in the oil shale to liquid and gaseous products.

One method of supplying the hot retorting gases used for converting kerogen contained in the oil shale, as described in the '423 patent, includes the establishment of a combustion zone in the retort and the movement of an oxygen supplying gaseous feed mixture into the combustion zone to advance the combustion zone through the retort. In the combustion zone, oxygen in the gaseous feed mixture is depleted by reaction with hot carbonaceous materials to produce heat and combustion gas. By the continued introduction of the oxygen supplying gaseous feed mixture into the combustion zone, the combustion zone is advanced through the retort.

The combustion gas and the portion of the gaseous feed mixture which does not take part in the combustion process pass through the retort on the advancing side of the combustion zone to heat the oil shale in a retorting zone to a temperature sufficient to produce kerogen decomposition, called retorting, in the oil shale to gaseous and liquid products and a residue of solid carbonaceous material.

The liquid products and gaseous products are cooled by the cooler oil shale particles in the retort on the advancing side of the retorting zone. The liquid carbonaceous products, together with water, are withdrawn from the bottom of the retort through the production drift. An off gas containing combustion gas generated in the combustion zone, product gas produced in the retorting zone, gas from carbonate decomposition, and gaseous feed mixture that does not take part in the combustion process is also withdrawn from the bottom of the retort through the production drift.

The off gas contains nitrogen, hydrogen, carbon monoxide, carbon dioxide, water vapor, methane and other hydrocarbons, and sulfur compounds such as hydrogen sulfide. Hydrogen sulfide is an extremely toxic gas with a toxicity greater than that of hydrogen cyanide. It also possesses a powerful, objectionable odor with a threshold for human smell of about 0.0003 ppm. In addition, carbon monoxide contained in off gas is toxic. For this reason it is desirable to isolate workers from the off gas. This has been difficult to accomplish because the production tunnel or drift is used for two functions. It is used for excavating formation to prepare new in situ oil shale retorts in a retort preparation region of the formation and at the same time it is used for withdrawing off gas from active retorts in a producing region of the formation.

Therefore, there is a need for a method for recovering liquid and gaseous products from oil shale in a subterranean formation which avoids the danger of exposing workers to the off gas.

SUMMARY OF THE INVENTION

Thus there is provided a method for recovering liquid and gaseous products from an in situ oil shale retort in a subterranean formation containing oil shale. The in situ retort has a bottom boundary of unfragmented formation and contains a fragmented permeable mass of formation particles containing oil shale. According to the method of this invention oil shale contained in the fragmented mass is retorted to produce gaseous and liquid products. The liquid products are withdrawn from the retort to a first level in unfragmented formation below the elevation of the bottom boundary of the retort. Gaseous products are withdrawn from the retort to a second level in unfragmented formation below the elevation of the first level.

Exemplary of an embodiment of this invention is a subterranean formation which includes a producing region, a retort preparation or mining region, a gas collection level, and a liquid collection level. The producing region has a plurality of in situ oil shale retorts, each retort containing a fragmented permeable mass of formation particles containing oil shale and having a bottom boundary of unfragmented formation. The bottom boundaries of the retorts are each at substantially the same elevation. Four operations are performed concurrently: oil shale contained in the fragmented mass of particles in a plurality of retorts in the producing region are retorted to produce gaseous and liquid products in such retorts; liquid and gaseous products are withdrawn from such retorts to a portion of the liquid collection level which is in unfragmented formation in the producing region at or below the elevation of the bottom boundaries of such retorts; gaseous products are withdrawn from the liquid collection level to the gas collection level which is in unfragmented formation bounding the retorts and out of fluid communication with the retort preparation region; and formation is excavated in the retort preparation region to a portion of the liquid collection level in the retort preparation region. To avoid exposing workers in the retort preparation region to the gaseous products, gaseous products are prevented from passing to the portion of the liquid collection level in the retort preparation region. This can be effected by providing a gas impervious barrier in the liquid collection level between the portion of the liquid collection level in the producing region and the portion of liquid collection level in the retort preparation region. Also, the pressure in the gas collection level can be maintained lower than the pressure in the portion of the liquid collection level in the retort preparation region to protect workers from the gaseous products.

DRAWINGS

These and other features, aspects and advantages of the present invention will become more apparent upon consideration of the following description, appended claims, and accompanying drawings where:

Figure 1:
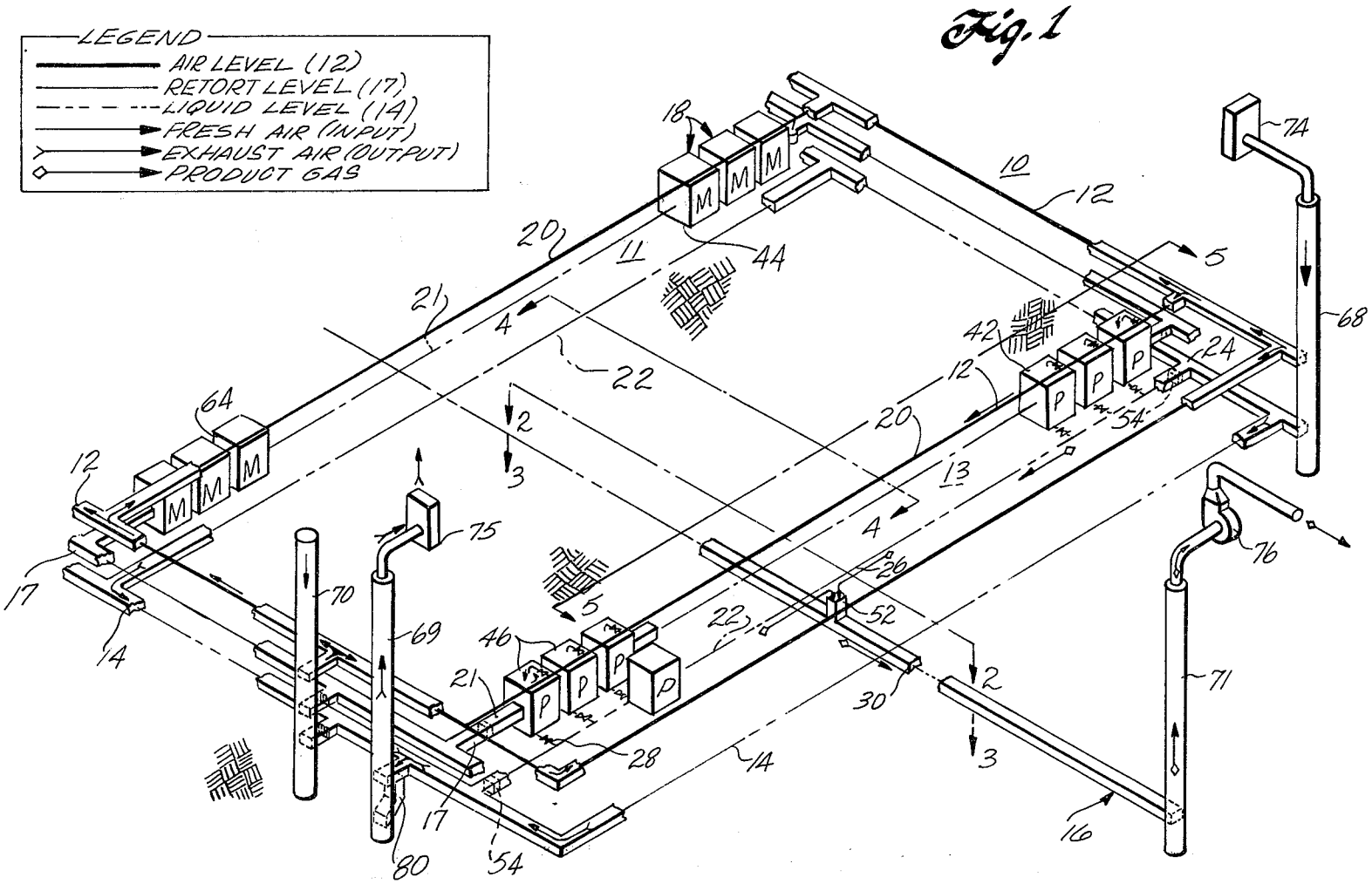
FIG. 1 is a perspective schematic view of a subterranean formation containing oil shale partially prepared for in situ retorting, the subterranean formation having a plurality of in situ oil shale retorts and including a liquid collection level and a gas collection level.
Figure 5:
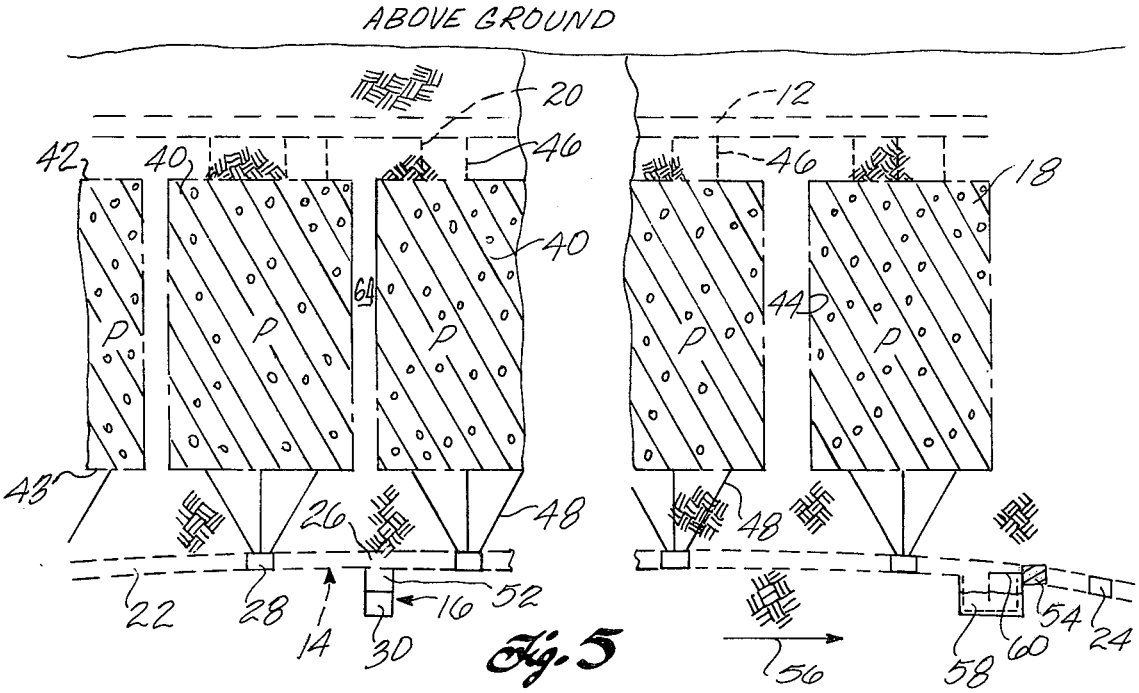
Figure 4:
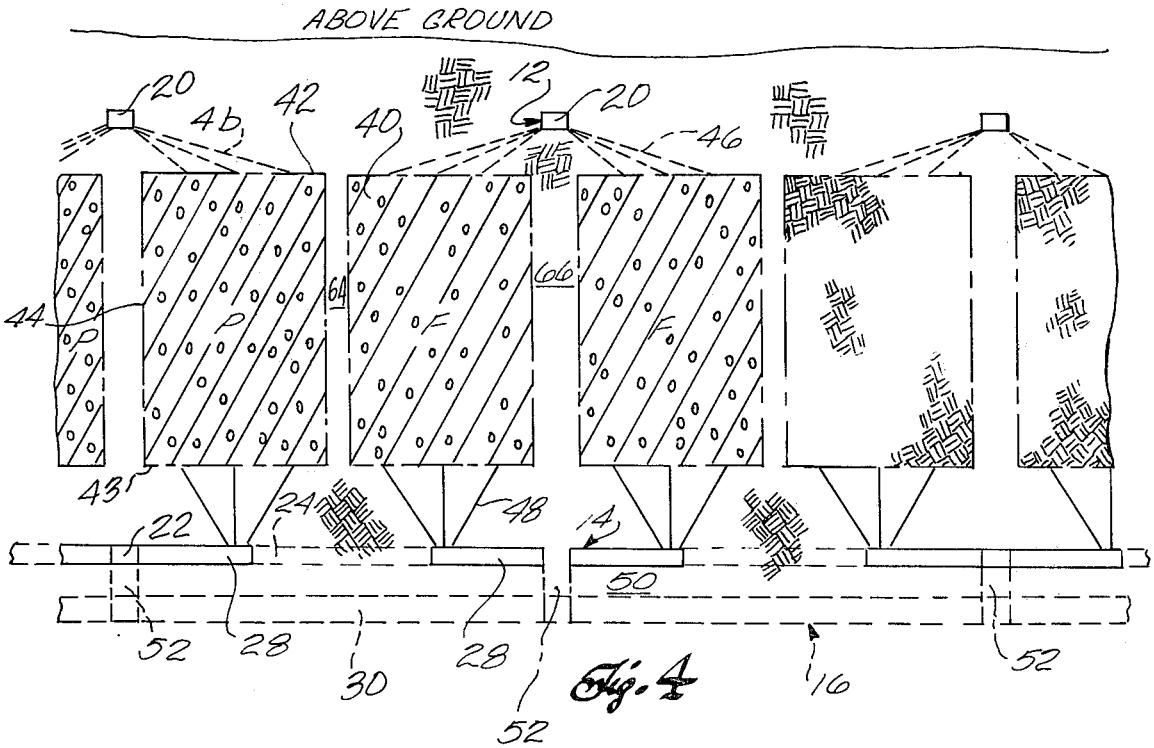

FIG. 4, which is taken along line 4—4 in FIG. 1, is a schematic view in vertical cross section of the subterranean formation of FIG. 1; and FIG. 5 is a view similar to the view of FIG. 4 taken along line 5—5 in FIG. 1.

DESCRIPTION

With reference to the drawings, a method according to this invention for recovering liquid and gaseous hydrocarbon products from a subterranean formation 10 containing oil shale includes retort preparation in a retort preparation region 11 of the formation and production of gaseous and liquid products in a production region 13 of the formation. Retort preparation and production product can be effected simultaneously. Each of these operations will now be described.

Figure 2:
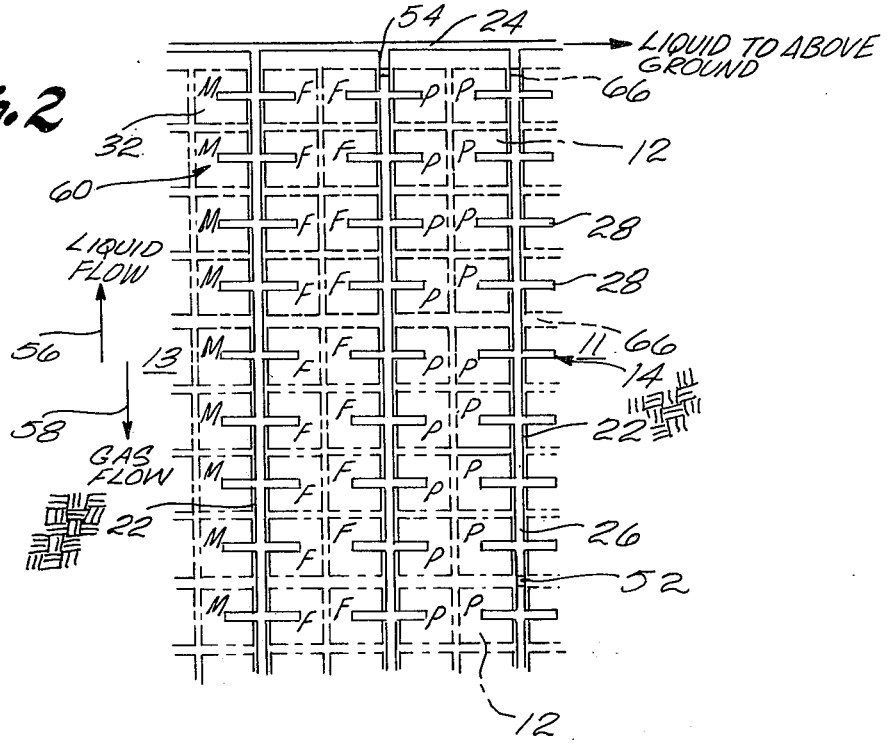
FIG. 2 is a plan view of the liquid collection level of the subterranean formation of FIG. 1 taken along line 2—2 in FIG. 1.
Figure 3:
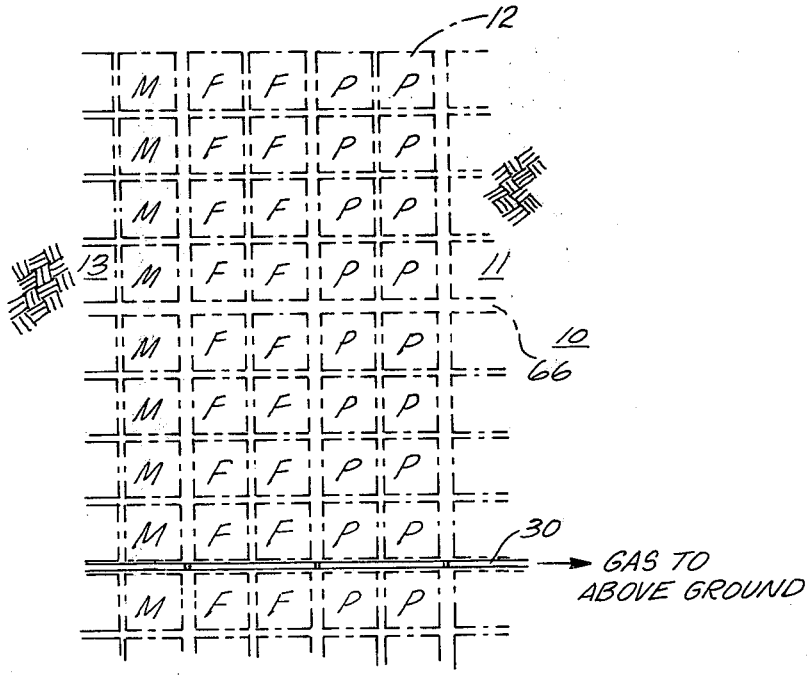
FIG. 3 is a plan view of the gas collection level of the subterranean formation of FIG. 1 taken along line 3—3 in FIG. 1.

As part of the retort preparation operation, at least three drift systems or levels are prepared in the subterranean formation 10, including an air level 12, a liquid collection or production level 14, and a gas collection level 16. One or more retort access levels 17 can also be provided. The retort access level is not shown in FIGS. 4 and 5. Plan views of a portion of the liquid collection level and a portion of the gas collection level are shown in FIGS. 2 and 3, respectively. As used herein, the term "level" means one or more generally horizontally extending passages or drifts.

The air level 12 is prepared in unfragmented formation 10 at an elevation higher than the elevation of the upper boundaries 46 of a plurality of in situ oil shale retorts 18 to be formed in the formation. The liquid collection level 14 is at an elevation below the elevation of the bottom boundaries 43 of the in situ oil shale retorts 18, and the gas collection level 16 is at an elevation lower than the elevation of the liquid collection level. The retort access level 17 is at an elevation between the upper and lower boundaries of the retorts 18. For clarity, only a portion of the retorts 18 are shown in FIG. 1 and portions of the levels are shown by lines as indicated in the drawing legend.

Access to each of the levels from above ground for preparation of the levels is achieved by means of one or more access shafts. The shafts provided are an emergency ventilation shaft 68, a production shaft 69, a service shaft 70, and a product gas shaft 71. The emergency ventilation shaft 68, production shaft 69, and service shaft 70 each provide access to the air level 12, liquid collection level 14, and retort preparation level 17 for preparation of retorts in the subterranean formation. Only the product gas shaft provides access to the gas level 16 and the gas shaft is isolated from underground workings on the other levels by unfragmented formation.

In addition to providing access to the levels in the formation during the retort preparation operation, the shafts also function during the production operation. The production shaft 69 is used for ventilation exhaust and liquid product removal. A muck loading facility 80, indicated schematically in FIG. 1 is provided at the bottom of the production shaft for removing excavated formation as well as removal of fragmented formation produced in excavating the levels and voids within the retorts being formed. The service shaft 70 serves as intake for process and ventilation air. The product gas shaft 71 is used for withdrawing gaseous products from the subterranean formation. The emergency ventilation shaft 68 is used to provide additional mine ventilation air and serve as an emergency escape way. Emergency ventilation shaft 68 can be equipped with an axial blower 74 to provide some ventilation air.

Primary ventilation air and process air enter the levels through the service shaft 70, and ventilation air is withdrawn from the levels via the production shaft 69, which is equipped with an axial blower 75. Fresh air used for ventilation and process air are pulled into the levels via the production shaft 69 under negative pressure provided by the axial fan 75, and a centrifugal blower 76 positioned at the above ground terminus of the product gas shaft 71.

The air level 12, the retort access level 17, and the liquid collection level 14 each comprises a plurality of parallel, spaced apart cross drifts 20, 21 and 22, respectively. There is a retort access drift 21 for each row of retorts. Each liquid collection cross drift 22 is between two rows of retorts and is substantially directly below an air cross drift 20. A liquid collection cross drift 22 and an air cross drift 20 are provided for each two rows of retorts. At each end of the liquid collection cross drifts 22 there is a main liquid collection drift 24 which is generally perpendicular to the liquid collection cross drifts 22. As shown most clearly in FIG. 5 there is a slight pitch or slope in each liquid collection cross drift 22 from its longitudinal center 26 toward each of the main liquid collection drifts 24, so liquid produced during the production operation flows toward the main collection drifts. The pitch in the cross drifts of the liquid collection level can follow the bedding plane of the formation toward at least one end of the cross drift.

Each air drift 20 and each cross drift 22 of the liquid collection system serves two rows of retorts 18. As best seen in FIG. 2, from each such cross drift of the liquid collection system, a stub drift 28 which can be blocked to gas flow is driven for each of the retorts to below the center point of the retort. Each stub drift is substantially perpendicular to the longitudinal axis of the cross drift from which it is driven. The stub drifts are used to collect liquid and gaseous products from the retorts and convey the products to a cross drift 22, which in turn serves to convey liquid products to a main liquid collection drift 24 and gaseous products to the gas collection drift system 14.

The gas collection drift system 14 comprises a single drift 30 which extends longitudinally in a direction parallel to the direction the main drifts 24 of the liquid collection systems extend, and which is below the center 26 of each of the cross drifts 22 of the liquid level. The gas collection drift 30 is dedicated to collecting gas from active retorts in the producing region of the formation. Preferably the gas collection drift 30 is smooth-lined with a material such as concrete to withstand corrosive effects of the gaseous products and to avoid seepage of the gas into areas in which personnel are working and leakage of air and water into the gas level.

All four levels and all shafts can be prepared with conventional excavating equipment according to standard mining techniques.

To prepare a retort, formation from within the boundaries of an in situ oil shale retort being prepared is excavated or mined to a liquid collection drift to form at least one void, thereby leaving a second portion of the formation within the boundaries of the in situ oil shale retort being prepared. Excavated formation removed at a retort preparation level can be passed to the liquid level by bypass raises (not shown). The excavated formation is transferred from the liquid collection level to above ground by way of the production shaft. This operation occurs in the retort preparation 13 region of the formation. Retorts being formed in the retort preparation region are designated with the letter "M" in the drawings.

A variety of mining schemes can be used for preparation of the retorts. For example, the method described in the aforementioned U.S. Pat. No. 3,661,423 can be used. According to this method, an undercut or void is excavated to the length and width of the in situ oil shale retort being formed. A plurality of small support pillars are left in the undercut. Only a limited height of the formation is excavated, generally from about 5 to about 25% of the formation within the boundaries of a retort being formed. This method does not require a retort access level 17 with retort access drifts 21. The undercut can be excavated from the liquid collection level, which can be at the elevation of the bottom boundary of the retort being formed.

Alternatively one or more horizontal voids can be excavated within the boundaries of the in situ oil shale retort being formed, as described in U.S. Patent application Ser. No. 659,899, filed on Feb. 20, 1976, now U.S. Pat. No. 4,043,598 assigned to the assignee of this application, and incorporated herein by reference. If more than one horizontal void is excavated within the boundaries of the in situ oil shale retort being formed, more than one retort access level 17 having retort access drifts 21 can be required, as more fully described in U.S. Patent application Ser. No. 659,899. Alternatively, one or more columnar voids, each void having a vertically extending free face can be excavated in the subterranean oil shale formation as described in U.S. Patent application Ser. No. 603,704, filed on Aug. 11, 1975, now U.S. Pat. No. 4,043,595, assigned to the assignee of this invention, and incorporated herein by reference. The columnar void can be cylindrical or a slot having one or more large parallel, planar vertical free faces.

After excavating one or more voids, remaining formation within the boundaries of an oil shale retort being formed is fragmented by explosive expansion toward such a void to form a fragmented permeable mass of formation particles containing oil shale. Each retort 12 designated by the letter "F" in the drawings contains a fragmented permeable mass of formation particles containing oil shale, and has top 42, bottom 43 and side 44 boundaries of unfragmented formation. Between adjacent retorts is left a zone of unfragmented formation serving as a pillar 64 to at least partly support overlying formation and as a gas barrier to prevent flow of gases between adjacent retorts.

After fragmentation is completed, final preparation steps for producing liquid and gaseous products from a retort are effected. These include drilling a plurality of feed gas inlet passages 46 downwardly from the air drift 20 to the upper boundary 42 of a retort so oxygen containing gas can be supplied to the retort during the production operation. Similarly, a plurality of bore holes or raises 48 are drilled upwardly from the liquid collection level 14 to the bottom boundary of each retort for removal of liquid and gaseous products from the retorts to the liquid collection level. The bottom bore holes 48 can be fan drilled upwardly in a five-spot, or as shown in FIGS. 4 and 5, a nine-spot pattern. The bottom bore holes 48 for each retort 18 are drilled from the end of a stub drift 28.

Explosives are placed in the portion of the formation 50 (FIG. 4) between the gas collection drift 30 and the mid-point 26 of each cross drift 22 of the liquid collection drift system 14 for blasting the formation to provide a raise or winze 52 between the gas and liquid collection levels. A pit (not shown) can be excavated in the floor of the gas collection drift below the winze 52 so rubble resulting from blasting formation to form the winze can fall into the pit and not obstruct gas flow in the gas collection. A gas impervious barrier or stoppage such as a bulkhead 54 is provided at each end of the cross drift 22 of the liquid collection level and each cross drift 21 of the retort access level 17 to prevent gas produced during the production operation from entering those portions of the liquid collection and retort access drift systems where mining and fragmenting operations are occurring. Such bulkheads are installed after all of the retorts communicating with the respective cross drift are completed and ready for retorting. After the bulkheads are in place, explosives in the formation 50 between the gas and liquid collection levels can be detonated to provide the raises 52 for passing gaseous products from the liquid collection level to the gas collection level.

Retorts which have been completely formed are designated by the letter "F" in the Drawings.

During the production operation, a combustion zone is established in retorts marked with the letter "P" in the drawings, and advanced downwardly through the the retort by introducing as a combustion zone feed a gaseous feed containing an oxygen supplying gas, into the in situ oil shale retort through the air drift 20 and down through the feed gas inlet passages 46. The combustion zone feed can contain air or air mixed with other gases such as gas produced during the production operation, steam, or an inert gas such as nitrogen. As the combustion zone feed is introduced to the retort 18, oxygen oxidizes carbonaceous material in the oil shale to produce a combustion gas. Heat from the exothermic oxidation reactions carried by flowing gases advances the combustion zone downwardly through the fragmented permeable mass of particles.

Combustion gas produced in the combustion zone and any unreacted portion of the oxygen supplying gaseous feed pass through the fragmented mass of particles on the advancing side of the combustion zone to establish a retorting zone on the advancing side of the combustion zone. Kerogen in the oil shale is retorted in the retorting zone to produce liquid and gaseous products.

The liquid and an off gas containing gaseous products pass through the bottom bore holes 48 to the stub drift of the liquid collection level and advance to the cross drifts 22. Because of the pitch or slope of the cross drifts 22, liquid products flow toward the ends of the cross drifts as indicated by arrow 56 in FIG. 2. The liquid products are collected in a sump 58 provided at each end of the liquid collection drift upstream of the bulkhead 54. A conduit 60 extending from the sump 58 through the bulkhead 54 is used for withdrawing liquid products into a main liquid collection drift 24, and passing the liquid products to above ground. A pump (not shown) is used for passing liquid products to the surface.

An off gas containing gaseous products, combustion gas, gas from carbonate decomposition, and any unreacted portion of the oxygen supplying gaseous feed is also present in the stub drift 28 and the cross drifts 22. However, the off gas, which contains toxic compounds such as carbon monoxide and sulfur such as hydrogen sulfide, is prevented from entering the main liquid collection drift, and other portions of the liquid collection level where retort preparation is occurring, by the bulkheads 54 at each end of the cross drifts. Instead, off gas is withdrawn to the liquid collection level 16 via the raises 52 connecting the gas and liquid collection levels, and from the gas collection level passed to above ground.

Preferably off gas containing gaseous products is withdrawn through the liquid collection level and gas level by a pump having a substantial pressure gain, such as the centrifugal blower 76, so the pressure in the gas collection level can be maintained lower than the pressure in the liquid collection level, and particularly the portion of the liquid collection level in the retort preparation region of the formation where operating personnel are present. Thus, if a gas leak were to occur in a region containing off gas, such leak would result in leakage of gas into the gas collection system rather than leakage of toxic off gas out of the gas collection system into a region in which operating personnel are working.

The direction of gas flow in the liquid collection level and gas flow in the gas collection level are indicated in FIG. 2 by arrows 56 and 59, respectively.

It should be understood that although the invention has been described in terms of the steps of level preparation, mining, fragmentation, and producing being effected successively, in practice the steps can be effected simultaneously. That is, only a portion of each level can be prepared, and simultaneously with preparation of the levels, mining, fragmentation, and production of liquid and gaseous product are effected. For example, as shown in the Drawings, simultaneously with the production of gaseous and liquid products in retorts "P", fragmentation of formation and mining of formation are occurring in the retorts labeled "M". However, preferably the gas collection level is completed, sealed, and dedicated to gas withdrawal before a combustion zone is established in any of the retorts in the subterranean formation 10 so operating personnel are not exposed to toxic off gas produced during the production operation.

As used herein, the term "producing region" refers to a region of the subterranean formation 10 in which liquid and/or gaseous products are being produced from oil shale. The term "retort preparation region" refers to a region of the subterranean formation 10 where retorts are being formed and formation is being prepared for production of liquid and gaseous products. Such region includes regions of the formation where drift systems are being prepared, formation is being excavated, formation is being fragmented, and/or a base of operations is located. Thus, with reference to the Drawings, retorts labeled "P" are in the producing region. The portion of the formation containing retorts which are not yet completely formed, which are labeled "M", is in the retort preparation region, since fragmentation of formation to prepare in situ oil shale retorts has not yet been completed. The region of the formation containing retorts labeled "F" serves as a buffer region between the retort preparation region and the producing region. Formation of the retorts in the buffer region is complete, i.e. all steps necessary prior to establishment of a combustion zone in the retorts have been accomplished. The buffer region of the formation helps prevent any gas which may leak from producing retorts from entering the retort preparation region of the formation where operating and mining personnel are working.

According to the version of this invention shown in the Drawings, liquid and gaseous products are withdrawn from a retort to the liquid collection level and then gaseous products are passed to the gas collection level from the liquid collection level. Thus there is no direct fluid communication between the gas collection level and the retort. All fluid communication between the retorts and the gas level is through the liquid level. In another version of this invention, the gaseous and liquid products can be withdrawn directly to a gas collection level, and from the gas collection level, the liquid products can be passed to a liquid collection level. In this latter version of the invention the liquid collection level is not in direct fluid connection with the retorts. Alternatively, liquid products can be withdrawn directly to the liquid collection level and gaseous products can be withdrawn directly to the gas collection level.

As shown in FIGS. 4 and 5, the bottom boundaries of the retorts can be at substantially the same elevation, with the elevation of the liquid collection level being lower than the elevation of the bottom boundaries of the retorts, and the elevation of the gas collection level being lower than the elevation of the liquid collection level. In another version of the invention, the elevation of the liquid collection level can be the same as the elevation of the bottom boundaries of the retorts.

It is preferred that the gas level be at a lower elevation than the liquid collection level in which men are required to work in excavating for formation of retorts. Oil shale is found in stratified deposits and in many cases the deposits have substantially horizontal bedding planes. During the excavation of the underground workings and formation of retorts, there is considerable blasting with some likelihood of producing cracks in the formation through which gases might pass. Such damages to the rock structure can occur along the bedding planes. It is therefore desirable to have the gas collection level at an elevation different from the liquid collection level.

Further, the liquid collection level should be relatively near the bottoms of the retorts being formed since this assists in excavation and formation of retorts. Placement of the gas collection level at an elevation above the liquid level through which formation is excavated would place the gas collection level in regions to be occupied by retorts or sufficiently close to elevations at which retorts are being prepared that there could be a substantial likelihood of damage to the gas level due to nearby blasting. It is desirable that the gas collection level be positioned so that there are no other underground workings near it. It is therefore preferred that the gas collection level be at an elevation below the liquid collection level, which is at or below the bottoms of the in situ oil shale retorts.

A sump (not shown) can be provided in the gas collection drift 30 or at the bottom of the gas shaft 71 for ground water and liquid products which may enter the off gas collection system. Such products could include liquids entrained by the gaseous products. Pumps can be provided in the gas collection drift to transfer any such water and liquid products to the main sumps 58 in the liquid collection drifts.

All of the retorts serviced by a single liquid collection cross drift 22 are not necessarily used to produce gaseous and liquid products simultaneously. For example, all of the retorts in one of the two rows served by a single collection cross drift can be retorted together, and then all of the retorts in the other row can be retorted. Also, the retorts in a single row of retorts can be retorted sequentially or simultaneously, or retorts in groups of two or more can be processed together, depending upon production requirements.

EXAMPLE

This example illustrates production of liquid and gaseous products from oil shale according to a method having features of this invention.

A site is selected in the Piceance Creek structural basin in Colorado. Three 34-feet diameter shafts are sunk downwardly into the formation. These three shafts are a production shaft 69, a service shaft 70, and a gas shaft 71. A 12-feet diameter emergency air inlet shaft 68 also is provided. A large pillar of undisturbed formations is left around each of these four shafts. Each shaft is sunk by conventional methods.

The production shaft 69 is used for removing excavated formation, ventilation exhaust, and liquid product removal and is sunk about 1750 feet deep to a liquid collection level. The production shaft is smooth-lined with concrete. The service shaft 70 serves as intake for process and ventilation air. It is smooth-lined with concrete and is sunk at least about 1750 feet deep to the liquid collection level. The gas shaft 71 also is smooth-lined with concrete. The depth of the gas shaft at the gas collection level is about 1820 feet.

The formation is developed in panels, each panel consisting of four rows of clusters 62, with eight clusters per row. Each cluster 62 consists of eight retorts 18, the retorts being aligned in rows of two by four. Each retort is 200 feet square by 310 feet high and separated from adjacent retorts by pillars 64 about twenty-five feet thick. Pillars 66 are provided between clusters and are about fifty feet thick.

An air level 12, a liquid collection or production level 14, and a gas collection level 16 are prepared in the formation. The air level is at an elevation of 1290 feet below ground surface, the liquid production level is at an elevation of 1750 feet below ground surface, and the gas level is at an elevation of 1810 feet below ground surface. Air drifts 20, which are about thirty feet square, are driven over the pillars 66 between clusters at a distance of about fifty-five feet above the top boundaries of the retorts. Since the air drifts 20 are driven over the pillar between rows of clusters, two rows of retorts can be serviced from one air drift. Raises or air passages 46 are drilled downwardly into the retorts to be formed for introduction of air into the retorts during the production operation.

Similarly, liquid collection level cross drifts about thirty feet wide by twenty feet high are driven under the pillars 66 between two rows of clusters about eighty-five feet below the bottom boundaries of the retorts. At each end of each liquid collection cross drift 22 there is a main collection drift 24 which is about thirty feet wide by twenty feet high. From the cross drifts, stubs about twenty feet by twenty feet are driven to directly below the center of each retort. Several holes are fan drilled upwardly in each retort bottom from a stub.

The gas level comprises a single drift 30 about thirty feet by thirty feet driven from the gas shaft 71. Alternatively a temporary ramp can be excavated from the liquid level for driving the gas collection drift, and later sealed to dedicate the gas level. The gas collection drift 30 extends underneath the center points of the cross drifts of the liquid collection level. There is a thirty feet long raise for each cross drift of the liquid collection system to connect each such cross drift to the gas level drift.

The gas level is dedicated to collection of gaseous products and no access is needed for the life of the panel. A stub drift having a stoppage can be provided connecting to the gas level drift 30 for future access to the gas collection level for additional panels.

The upper boundary of each of the retorts to be formed is about forty-five feet below the air level, and the bottom boundary of each of the retorts is about 105 feet above the liquid collection level. About 20 to 25% of the formation within the boundaries of a retort to be formed is excavated to the liquid collection level and withdrawn through the production shaft to above ground for forming at least one void in the retort site. The remaining formation within the boundaries of the retort to be formed is explosively expanded toward such a void and fragmented to yield a fragmented permeable mass of formation particles in each retort.

After formation of the in situ retorts served by a single cross drift of the liquid collection system, the cross drift is bulkheaded at each end, and a combustion zone is established in one or more of the retorts served by the cross drift 22. The combustion zone is advanced downwardly through the retort by introduction of air via the service shaft 70 and the air level 12. Preferably the air is diluted with steam. Heat is transferred to a retorting zone on the advancing side of the combustion zone wherein retorting of kerogen in the oil shale occurs, with production of gaseous and liquid products. The liquid and gaseous products are withdrawn to the liquid collection level 14 and, from there, the gaseous products are withdrawn to the gas collection level 16. Liquid products are then transferred to above ground via the production shaft 69 and gaseous products are withdrawn to the surface via the product gas shaft 71.

By recovering liquid and gaseous products from oil shale in a subterranean formation containing oil shale according to the method of this invention, personnel engaged in preparation of retorts and personnel engaged in operating active retorts are protected from noxious gases produced by retorting oil shale. Such protection results from using a dedicated gas collection drift system and by maintaining a pressure in the gas collection drift system lower than the pressure in the retort preparation region of the formation and the region of the formation where retort operating personnel are working. Also, the presence of a buffer region or zone of retorts containing a fragmented permeable mass of formation particles between active retorts and the retort preparation region helps prevent gaseous products from reaching operating and retort preparation personnel.

Although this invention has been described in considerable detail with reference to certain versions thereof, other versions are within the scope of this invention. For example, although this invention has been described in terms of a plurality of retorts where the bottom boundaries of the retorts are each at substantially the same elevation, a separate liquid collection level and a separate gas collection level can effectively be used with a single retort, or with a plurality of retorts where the bottom boundaries of the retorts are not at substantially the same level. Thus, the spirit and scope of the appended claims should not necessarily be limited to the description of the preferred versions contained herein.

What is claimed is:

1. A method for recovering liquid and gaseous products from an in situ oil shale retort in a subterranean formation containing oil shale, the in situ retort having a bottom boundary of unfragmented formation and containing a fragmented permeable mass of formation particles containing oil shale, the method comprising the steps of:

retorting oil shale contained in the fragmented mass to produce gaseous and liquid products;

withdrawing liquid products from the retort to a first level in unfragmented formation below the elevation of the bottom boundary of the retort;

withdrawing gaseous products from the retort to the first level; and withdrawing gaseous products from the first level to a second level in unfragmented formation below the elevation of the first level.

2. The method of claim 1 wherein substantially all fluid communication between the retort and the second level is by way of the first level.

3. The method of claim 1 wherein the in situ retort is in a producing region of the subterranean formation and the subterranean formation includes a retort preparation region, the method including the step of sealing a portion of the first level in the producing region of the formation from a portion of the first level in the retort preparation region of the formation for preventing gaseous products from entering the retort preparation region.

4. A method for recovering liquid and gaseous products from an in situ oil shale retort in a subterranean formation containing oil shale, the in situ retort having a bottom boundary of unfragmented formation and containing a fragmented permeable mass of formation particles containing oil shale, the method comprising the steps of:

retorting oil shale contained in the fragmented mass to produce gaseous and liquid products;

withdrawing liquid products from the retort to a liquid collection drift system in unfragmented formation at or below the elevation of the bottom boundary of the retort;

withdrawing gaseous products from the retort to the liquid collection drift system; and passing gaseous products from the liquid collection drift system to a gas collection drift system in unfragmented formation at or below the elevation of the liquid collection drift system.

5. The method of claim 4 substantially all fluid communication between the retort and the gas collection drift system is by way of the liquid collection drift system.

6. A method for recovering liquid and gaseous products from an in situ oil shale retort in a subterranean formation containing oil shale, the in situ retort having boundaries, including a bottom boundary of unfragmented formation and containing a fragmented permeable mass of formation particles containing oil shale, the method comprising the steps of:

providing a first drift system in fluid communication with the retort in unfragmented formation at or below the elevation of the bottom boundary of the retort;

providing a second drift system in direct fluid communication with the first drift system, wherein substantially all fluid communication between the retort and the second drift system is by way of the first drift system;

retorting oil shale contained in the fragmented mass to produce gaseous and liquid products;

withdrawing liquid and gaseous products from the retort to the first drift system; and withdrawing one of the products from the first drift system to the second drift system.

7. The method of claim 6 wherein the product withdrawn from the first drift system to the second drift system comprises gaseous products.

8. The method of claim 7, wherein before the step of retorting:

establishing direct fluid communication between the bottom boundary of the fragmented mass and the first drift system;

sealing off a portion of the first drift system in direct fluid communication with the bottom boundary of the fragmented mass from a portion of the first drift system in a retort preparation region of the formation; and establishing communication between the portion of the first drift system in fluid communication with the bottom boundary of the fragmented mass and the second drift system.

9. The method of claim 6 including the steps of:

passing liquid products in one direction in a drift of the first drift system; and passing gaseous products in the opposite direction in the drift.

10. A method for recovering liquid and gaseous products from a plurality of in situ oil shale retorts in a subterranean formation containing oil shale, each in situ retort containing a fragmented permeable mass of formation particles containing oil shale and having a bottom boundary of unfragmented formation, wherein the bottom boundaries of the retorts are each at substantially the same elevation, the method comprising the steps of:

retorting oil shale contained in the fragmented masses of particles in a plurality of retorts to produce gaseous and liquid products in such retorts;

withdrawing liquid products from such retorts to a first drift system in unfragmented formation at or below the elevation of the bottom boundaries of the retorts;

withdrawing gaseous products from such retorts to the first drift system; and passing gaseous products from the first drift system to a second drift system in unfragmented formation below the elevation of the first drift system.

11. A method of recovering shale oil and gaseous products from an in situ oil shale retort in a subterranean formation containing oil shale, said retort having a bottom boundary of unfragmented formation and containing a fragmented permeable mass of formation particles containing oil shale, comprising the steps of:

excavating a first drift through unfragmented formation at an elevation at or below the elevation of the bottom boundary of the retort being formed;

excavating to the first drift a first portion of the formation from within the boundaries of the in situ oil shale retort being formed to form at least one void, and transferring excavated formation from the first drift to above ground; leaving a second portion of said formation, which is to be fragmented by expansion toward such a void within said boundaries;

explosively expanding said second portion toward such a void to fragment said second portion and to form a fragmented permeable mass of formation particles containing oil shale, the mass having a bottom boundary of unfragmented formation;

excavating a second drift in unfragmented formation at an elevation below the elevation of the first drift;

providing direct fluid communication between the first drift and the bottom boundary of the retort;

providing direct fluid communication between the first drift and the second drift, wherein substantially all fluid communication between the retort and the second drift is by way of the first drift;

retorting oil shale contained in the in situ retort to produce shale oil and gaseous products therefrom;

withdrawing shale oil and gaseous products from the retort to the first drift; and withdrawing gaseous products from the first drift to the second drift.

12. The method of claim 11 comprising the additional step of passing shale oil from the first drift to above ground.

13. The method of claim 12 comprising the additional step of passing gaseous products from the second drift to above ground.

14. The method of claim 12 wherein the first drift has a gas impervious barrier across it and is pitched downwardly toward the gas impervious barrier, and wherein the step of passing shale oil to above ground includes passing shale oil from the first drift through the gas impervious barrier.

15. The method of claim 11 comprising the additional step of passing gaseous products from the second drift to above ground.

16. A subterranean formation containing oil shale prepared for in situ recovery of constituents from the formation comprising:

an in situ oil shale retort containing a fragmented permeable mass of formation particles containing oil shale, the retort having a bottom boundary of unfragmented formation;

a liquid collection drift system at a first elevation in unfragmented formation at or below the elevation of the bottom boundary of the retort for collection of liquid products produced from oil shale in the retort;

a gas collection drift system at a second elevation in unfragmented formation below the elevation of the liquid collection drift system for collection of gaseous products produced from oil shale in the retort;

fluid communication means for passing said liquid and gaseous products from the retort to the liquid collection drift system; and gas communication means for passsing said gaseous products from the liquid collection drift system to the gas collection drift system.

17. The formation of claim 16 comprising in addition means for passing liquid products from the liquid collection drift system to above ground.

18. The formation of claim 17, wherein the gas collection drift system is at less than ambient pressure, and including means for passing gaseous products from the gas collection drift system to above ground.

19. The formation of claim 16 comprising in addition means for passing gaseous products from the gas collection drift system to above ground.

20. A subterranean formation containing oil shale prepared for in situ recovery of constituents from the formation comprising:

a plurality of in situ oil shale retorts, each retort containing a fragmented permeable mass of formation particles containing oil shale, and each retort having a bottom boundary of unfragmented formation, wherein the bottom boundaries of the retorts are each at substantially the same elevation;

a liquid collection drift at a first elevation in unfragmented formation at or below the elevation of the bottom boundaries of the retorts for collection of liquid products produced from oil shale in the retorts;

a gas collection drift at a second elevation in unfragmented formation below the elevation of the liquid collection drift for collection of gaseous products produced from oil shale in the retorts;

fluid communication means for passing said liquid and gaseous products from the retorts to the liquid collection drift; and means for passing said gaseous products from the liquid collection drift to the gas collection drift.

21. The subterranean formation of claim 20 including means for sealing a producing region of the liquid collection drift from a retort preparation region of the collection drift for preventing gaseous products from entering the retort preparation region.

22. A subterranean formation containing oil shale prepared for in situ recovery of constituents from the formation comprising:

a plurality of in situ oil shale retorts, each retort containing a fragmented permeable mass of formation particles containing oil shale, and each retort having top, bottom and side boundaries of unfragmented formation, wherein the bottom boundaries of the retorts are ach at substantially the same elevation;

a plurality of liquid collection drifts at a first elevation in unfragmented formation below the elevation of the bottom boundaries of the retorts for collection of liquid products produced from oil shale in the retorts;

a gas collection drift at a second elevation in unfragmented formation below the elevation of the liquid collection drift for collection of gaseous products produced from oil shale in the retorts;

fluid communication means for passing said liquid and gaseous products from each of the retorts to at least one of the liquid collection drifts; and means for passing said gaseous products from each of the liquid collection drifts to the gas collection drift.

23. The formation of claim 22 further comprising means for passing liquid products from the liquid collection drifts to above ground and means for passing gaseous products from the gas collection drift to above ground.

24. A method for recovering liquid and gaseous products from a subterranean formation containing oil shale and including a producing region, a retort preparation region, a gas collection level, and a liquid collection level, the producing region having a plurality of in situ oil shale retorts, each retort containing a fragmented permeable mass of formation particles containing oil shale and having a bottom boundary of unfragmented formation, wherein the bottom boundaries of the retorts are each at substantially the same elevation, the method comprising the steps of:

retorting oil shale contained in the fragmented mass of particles in a plurality of retorts in the producing region to produce gaseous and liquid products in such retorts; while withdrawing liquid and gaseous products from such retorts to a portion of the liquid collection level which is in unfragmented formation in the producing region at or below the elevation of the bottom boundaries of such retorts; while withdrawing gaseous products from the liquid collection level to the gas collection level which is in unfragmented formation below the elevation of the liquid collection level and out of fluid communication with the retort preparation region; while excavating formation in the retort preparation region to a portion of the liquid collection level which is in unfragmented formation in the retort preparation region; and preventing gaseous products in the portion of the liquid collection level in the producing region from passing to the portion of the liquid collection level in the retort preparation region.

25. The method of claim 24 wherein the step of preventing comprises providing a gas impervious barrier in the liquid collection level between the portion of the liquid collection level in the producing region and the portion of the liquid collection level in the retort preparation region.

26. The method of claim 25 including the step of passing liquid products from the portion of the liquid collection level in the producing region to above ground.

27. The method of claim 26 wherein the step of passing comprises passing liquid products from the portion of the liquid collection level in the producing region through the gas impervious barrier to the portion of the liquid collection level in the retort preparation region, and passing liquid products from the portion of the liquid collection level in the retort preparation region to above ground.

28. The method of claim 24 including the steps of passing liquid products from the liquid collection level to above ground and passing gaseous products from the gas collection level to above ground.

29. The method of claim 24 wherein the steps of preventing comprises maintaining a pressure in the gas collection level lower than the pressure in the portion of the liquid collection level in the retort preparation region.

30. The method of claim 29 wherein the step of preventing comprises providing a gas impervious barrier in the liquid collection level between the portion of the liquid collection level in the producing region and the portion of the liquid collection level in the retort preparation region.

31. A method for recovering liquid and gaseous products from a subterranean formation containing oil shale and including a producing region, a retort preparation region, a gas collection drift system, and a liquid collection drift system, the liquid collection drift system having a portion in unfragmented formation in the producing region and a portion in unfragmented formation in the preparation region, the gas collection drift system being in direct fluid communication with the producing region of the liquid collection drift system, the producing region having a plurality of in situ oil shale retorts, each retort containing a fragmented permeable mass of formation particles containing oil shale and having boundaries, including a bottom boundary of unfragmented formation, wherein the bottom boundaries of the retorts are each at substantially the same elevation, the method comprising the steps of:

retorting oil shale contained in the fragmented masses of particles in a plurality of retorts in the producing region to produce gaseous and liquid products in such retorts; while withdrawing liquid products from such retorts to the gas collection drift system and passing liquid products from the gas collection drift system to the portion of the liquid collection drift system in unfragmented formation in the producing region, said portion in the producing region being at or below the elevation of the bottom boundaries of such retorts; while withdrawing gaseous products from such retorts to the gas collection drift system which is in unfragmented formation and out of fluid communication with the retort preparation region; and preventing gaseous products from passing to the portion of the liquid collection drift system in the retort preparation region.

32. A method for recovering liquid and gaseous products from a subterranean formation containing oil shale including a producing region, a retort preparation region, a gas collection drift system, and a liquid collection drift system, the liquid collection drift system having a portion in unfragmented formation in the producing region and a portion in unfragmented formation in the retort preparation region, the gas collection drift system being in direct fluid communication with the producing region of the liquid collection drift system, the producing region having a plurality of in situ oil shale retorts, each retort containing a fragmented permeable mass of formation particles containing oil shale and having boundaries, including a bottom boundary of unfragmented formation, wherein the bottom boundaries of the retorts are each at substantially the same elevation, the method comprising the steps of:

retorting oil shale contained in the fragmented masses of particles in a plurality of retorts in the producing region to produce gaseous and liquid products in such retorts; while withdrawing liquid products from such retorts to the postion of the liquid collection drift system in unfragmented formation in the producing region, said portion in the producing region being at or below the elevation of the bottom boundaries of such retorts; while withdrawing gaseous products from such retorts to the liquid collection drift system and passing gaseous products from the liquid collection drift system to the gas collection drift system which is in unfragmented formation and out of fluid communication with the retort preparation region; and preventing gaseous products from passing to the portion of the liquid collection drift system in the retort preparation region.

33. The method of claim 32 wherein the step of preventing comprises providing a gas impervious barrier in the liquid collection drift system between the portion of the liquid collection drift system in the producing region and the portion of the liquid collection drift system in the retort preparation region.

34. The method of claim 33 wherein the step of providing comprises fabricating a bulkhead.

35. The method of claim 33 including the step of passing liquid products from the portion of the liquid collection drift system in the producing region to above ground.

36. The method of claim 32 wherein the liquid collection drift system is at a higher elevation than the gas collection drift system.

37. A subterranean formation containing oil shale prepared for in situ recovery of constituents from the formation comprising:

a plurality of in situ oil shale retorts, each retort containing a fragmented permeable mass of formation particles containing oil shale, and each retort having a bottom boundary of unfragmented formation, wherein the bottom boundaries of the retorts are each at substantially the same elevation;

a gas collection drift at a first elevation in unfragmented formation below the elevation of the bottom boundaries of the retorts for collection of gaseous products produced from oil shale in the retorts;

a plurality of liquid collection drifts at a second elevation in unfragmented formation above the elevation of the gas collection and below the elevation of the bottom boundaries of the retorts for collection of liquid products produced from oil shale in the retorts;

boreholes for passing said liquid and gaseous products from each of the retorts to at least one of the liquid collection drifts;

a gas impervious barrier across at least one of such liquid collection drifts, wherein such liquid collection drift slopes downwardly toward the gas impervious barrier from a borehole between a retort and such liquid collection drift; and raises for passing said gaseous products from the liquid collection drifts to the gas collection drift.

38. The formation of claim 37 including means for passing liquid products from the liquid collection drifts to above ground, including means for passing liquid products through the gas impervious barrier.

39. The formation of claim 37 including a raise between the gas collection drift and each of the the liquid collection drifts to which liquid and gaseous products are passed through such a borehole.

40. The formation of claim 39 wherein such a raise between such a gas collection drift and such a liquid collection drift which slopes downwardly toward a gas impervious barrier is at the upward end of the slope.

41. A method for recovering liquid and gaseous products from a subterranean formation containing oil shale and including a producing region, a retort preparation region, a gas collection drift system, and a liquid collection drift system, the liquid collection drift system having a portion in unfragmented formation in the producing region and a portion in unfragmented formation in the retort preparation region, the gas collection drift system being in direct fluid communication with the producing region of the liquid collection drift system, the producing region having a plurality of in situ oil shale retorts, each retort containing a fragmented permeable mass of formation particles contaning oil shale and having boundaries, including a bottom boundary of unfragmented formation, wherein the bottom boundaries of the retorts are each at substantially the same elevation, wherein substantially all fluid communication between the retort and one of the drift systems is by way of the other drift system, the method comprising the steps of:

retorting oil shale contained in the fragmented masses of particles in a plurality of retorts in the producing region to produce gaseous and liquid products in such retorts; while withdrawing liquid products from such retorts to the portion of the liquid collection drift system in unfragmented formation in the producing region, said portion in the producing region being at or below the elevation of the bottom boundaries of such retorts; while withdrawing gaseous products from such retorts to the gas collection drift system which is in unfragmented formation and out of fluid communication with the retort preparation region; and preventing gaseous products from passing to the portion of the liquid collection drift system in the retort preparation region.

42. A method for recovering liquid and gaseous products from an in situ oil shale retort in a subterranean formation containing oil shale, the retort containing a fragmented permeable mass of formation particles containing oil shale and having a bottom boundary of unfragmented formation, the method comprising the steps of:

excavating a gas collection drift at a first elevation in unfragmented formation below the elevation of the bottom boundary of the retort for collection of gaseous products produced from oil shale in the retort;

excavating a sloping liquid collection drift at a second elevation in unfragmented formation above the elevation of the gas collection drift and below the elevation of the bottom boundary of the retort for collection of liquid products produced from oil shale in the retort, wherein the liquid collection drift slopes downwardly from the retort;

retorting oil shale contained in the fragmented mass to produce liquid and gaseous products;

withdrawing liquid and gaseous products from the retort to the liquid collection drift, wherein such liquid products flow downwardly along the liquid collection drift toward the gas impervious barrier; and withdrawing said gaseous products from the liquid collection drift to the gas collection drift.

43. The method of claim 42 including the step of providing a gas impervious barrier across the liquid collection drift, wherein the liquid collection drift slopes downwardly toward the gas impervious barrier.

44. The method of claim 43 including the step of passing liquid products from the liquid collection drift to above ground through the gas impervious barrier.

45. The method of claim 42 wherein said gaseous products are withdrawn to the gas collection drift from the liquid collection drift system at the upward end of the slope.

* * * * *

UNITED STATES PATENT AND TRADEMARK OFFICE

CERTIFICATE OF CORRECTION

PATENT NO. : 4,140,343

DATED : February 20, 1979

INVENTOR(S) : Eugene A. Mills

It is certified that error appears in the above-identified patent and that said Letters Patent are hereby corrected as shown below:

Column 12, Line 3, -- wherein -- should be inserted after "4" and before "substantially".

Column 16, Line 66, "postion" should be -- position --.

Column 18, Line 13, "contaning" should be -- containing --.

Signed and Sealed this

*Fifth* Day of *June 1979*

[SEAL]

*Attest:*

RUTH C. MASON
*Attesting Officer*

DONALD W. BANNER
*Commissioner of Patents and Trademarks*